US007603990B2

(12) United States Patent
Takakura et al.

(10) Patent No.: US 7,603,990 B2
(45) Date of Patent: Oct. 20, 2009

(54) FUEL VAPOR TREATMENT SYSTEM

(75) Inventors: Shinsuke Takakura, Kawasaki (JP); Masao Kano, Gamagori (JP); Noriyasu Amano, Gamagori (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 0 days.

(21) Appl. No.: 12/135,303

(22) Filed: Jun. 9, 2008

(65) Prior Publication Data

US 2009/0000603 A1 Jan. 1, 2009

(30) Foreign Application Priority Data

Jun. 28, 2007 (JP) ..... 2007-170121

(51) Int. Cl.
*F02M 33/02* (2006.01)

(52) U.S. Cl. ..... 123/520; 701/103

(58) Field of Classification Search ..... 123/516, 123/518–520; 701/103
See application file for complete search history.

(56) References Cited

U.S. PATENT DOCUMENTS

| | | | | |
|---|---|---|---|---|
| 4,377,142 | A * | 3/1983 | Otsuka et al. | 123/689 |
| 4,438,749 | A * | 3/1984 | Schwippert | 123/494 |
| 4,741,318 | A * | 5/1988 | Kortge et al. | 123/520 |
| 4,748,959 | A * | 6/1988 | Cook et al. | 123/406.45 |
| 4,809,667 | A * | 3/1989 | Uranishi et al. | 123/520 |
| 4,945,885 | A * | 8/1990 | Gonze et al. | 123/520 |
| 5,419,299 | A * | 5/1995 | Fukasawa et al. | 123/520 |
| 5,524,600 | A * | 6/1996 | Wild | 123/698 |
| 5,862,795 | A * | 1/1999 | Osanai | 123/520 |
| 5,957,115 | A * | 9/1999 | Busato et al. | 123/520 |
| 5,988,232 | A * | 11/1999 | Koch et al. | 141/59 |
| 6,079,393 | A | 6/2000 | Tsutsumi et al. | |
| 6,237,575 | B1 * | 5/2001 | Lampert et al. | 123/520 |
| 6,325,112 | B1 * | 12/2001 | Nanaji | 141/4 |
| 6,668,808 | B2 | 12/2003 | Tagami et al. | |
| 7,007,684 | B2 | 3/2006 | Itakura et al. | |
| 2005/0028792 | A1 * | 2/2005 | Hosoya et al. | 123/520 |
| 2005/0257607 | A1 * | 11/2005 | Suzuki | 73/118.1 |

FOREIGN PATENT DOCUMENTS

| | | |
|---|---|---|
| JP | 11-62729 | 3/1999 |
| JP | 2002-349366 | 12/2002 |
| JP | 2004-197607 | 7/2004 |
| JP | 2005-351216 | 12/2005 |

OTHER PUBLICATIONS

Japanese Office Action dated Apr. 7, 2009, issued in corresponding Japanese Application No. 2007-170121, with English translation.

* cited by examiner

*Primary Examiner*—Thomas N Moulis
(74) *Attorney, Agent, or Firm*—Nixon & Vanderhye P.C.

(57) ABSTRACT

An ECU computes a transit time from a time when the fuel vapor passes the purge valve right after the purge valve is opened until a time when the fuel vapor reaches a vicinity of the fuel injector. Further more, the ECU computes a fuel vapor concentration at the vicinity of the fuel injector after the transit time has elapsed based on a first-order lag curve which is defined by a maximum variation of the fuel vapor concentration and a time constant. Correcting the fuel injection quantity according to the fuel vapor concentration at the vicinity of the injector restricts a disturbance of air-fuel ratio at a time of starting purge process.

10 Claims, 3 Drawing Sheets

FUEL VAPOR TREATMENT SYSTEM

CROSS-REFERENCE TO RELATED APPLICATION

This application is based on Japanese Patent Application No.2007-170121 filed on Jun. 28, 2007, the disclosure of which is incorporated herein by reference.

FIELD OF THE INVENTION

The present invention relates to a fuel vapor treatment system which restricts fuel vapor generated in a fuel tank from being emitted into atmosphere.

BACKGROUND OF THE INVENTION

In a fuel vapor treatment system, fuel vapor generated in a fuel tank is temporarily adsorbed by a canister. During an engine is operated, the fuel vapor is desorbed from the canister and purged into an intake pipe through a purge passage. The purged fuel vapor is combusted in a combustion chamber of the engine. Such a purge process regenerates an adsorbing capacity of the canister.

While the purge process is conducted, fuel injected by a fuel injector and the fuel vapor are introduced into the combustion chamber to be combusted. The fuel injection quantity is adjusted in consideration of the fuel vapor quantity in order to restrict a disturbance of an air-fuel ratio.

It is important to accurately detect the fuel vapor concentration at a vicinity of the fuel injector in order to restrict the disturbance of the air-fuel ratio. In a system shown in JP-2005-351216A (U.S. Pat. No. 7,007,684B2), a fuel vapor concentration at a vicinity of the fuel injector is estimated based on a transit time from when the purge valve is opened to when the fuel vapor reaches the fuel injector and a change in concentration of the fuel vapor at the vicinity of the fuel injector. More specifically, the fuel vapor concentration at the vicinity of the fuel injector is estimated based on an assumption that the fuel vapor concentration at the vicinity of the injector changes linearly with respect to elapsed time.

However, according to the research of the inventors, the fuel vapor concentration at the vicinity of the fuel injector does not linearly change with respect to the elapsed time. Hence, in the system shown in the above patent document, the fuel vapor concentration at the vicinity of the fuel injector cannot be estimated accurately. The disturbance of air fuel ratio cannot be reliably restricted.

SUMMARY OF THE INVENTION

The present invention is made in view of the above matters, and it is an object of the present invention to provide a fuel vapor treatment system which is capable of estimating a fuel vapor concentration accurately at a vicinity of a fuel injector.

According to the present invention, a fuel vapor treatment system includes a transit time computing means for computing a first transit time from a time when the purge valve passes the purge valve right after the purge valve is opened until a time when the fuel vapor reaches a vicinity of the fuel injector; and a concentration computing means for computing a fuel vapor concentration at the vicinity of the fuel injector after the first transit time has elapsed based on a first-order lag curve which is defined by a maximum variation of the fuel vapor concentration and a time constant.

According to simulation results conducted by the inventors, it is found that a change in fuel vapor concentration at a vicinity of the fuel injector after the first transit time has passed in a case of starting a purge process corresponds to a first-order lag with respect to an elapsed time. This simulation results are confirmed with respect to various type of engines.

Hence, the fuel vapor concentration at a vicinity of the fuel injector in a case of starting the purge process can be accurately estimated A fuel injection correction in accordance with the fuel vapor concentration is properly conducted, whereby a disturbance of air-fuel ratio can be avoided at a time of starting the purge process.

According to another aspect of the present invention, a fuel vapor treatment system includes a transit time computing means for computing a second transit time from a time when the purge valve passes the purge valve right before the purge valve is closed until a time when the fuel vapor reaches a vicinity of the fuel injector, and a concentration computing means for computing a fuel vapor concentration at the vicinity of the fuel injector after the second transit time has elapsed based on a first-order lag curve which is defined by a maximum variation of the fuel vapor concentration and a time constant, According to simulation results conducted by the inventors, it is found that a change in fuel vapor concentration at a vicinity of the fuel injector after the second transit time has passed in a case of terminating a purge process corresponds to a first-order lag with respect to an elapsed time. This simulation results are confirmed with respect to various type of engines.

Hence, the fuel vapor concentration at a vicinity of the fuel injector in a case of terminating the purge process can be accurately estimated. A fuel injection correction in accordance with the fuel vapor concentration is properly conducted, whereby a disturbance of air-fuel ratio can be avoided at a time of terminating.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Figure 1:
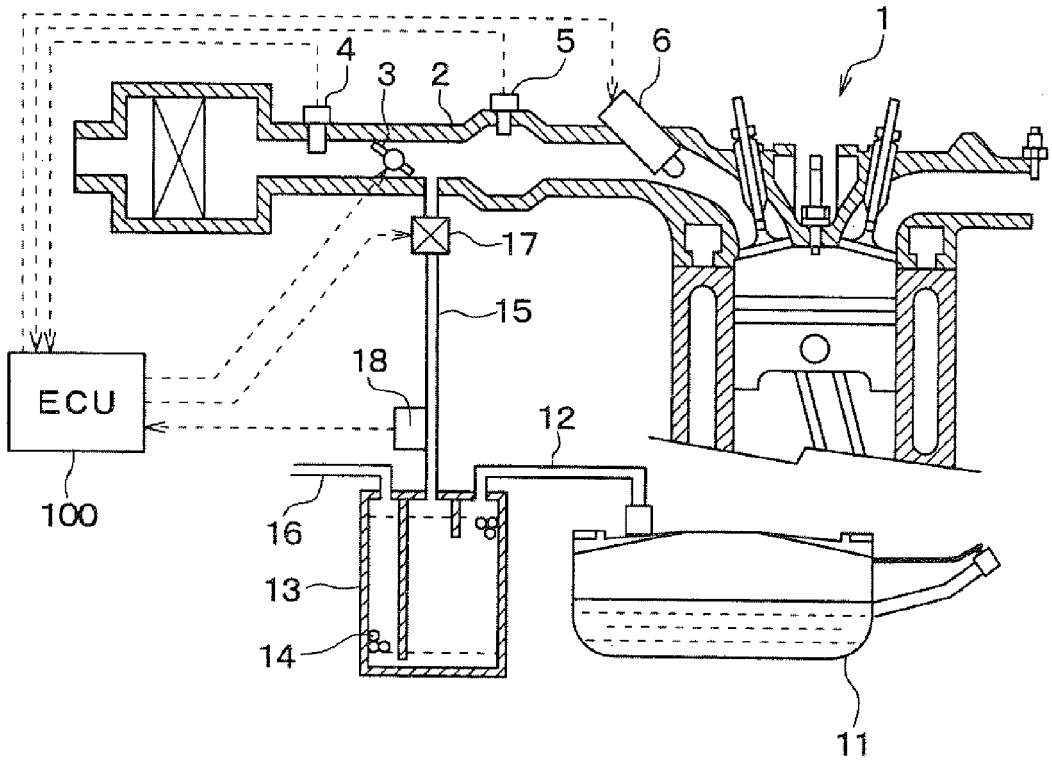
FIG. 1 is a schematic view of an internal combustion engine for the vehicles which has a fuel vapor treatment system.

Hereafter, a first embodiment of the present invention is described. FIG. 1 is a schematic view of an internal combustion engine for a vehicle which has a fuel vapor treatment system.

A throttle valve 3 which adjusts intake air flow rate is provided in an intake pipe 2. An air flow sensor 4 which detects the intake air flow rate is arranged upstream of the throttle valve 3. An intake pressure sensor 5 and a fuel injector 6 are arranged downstream of the throttle valve 3.

A fuel tank 11 is communicated to a canister 13 through a pipe 12. The canister 13 is filled with absorbents 14. Fuel vapor evaporated in the fuel tank 11 flows toward the canister 13 through the pipe 12 and is adsorbed by the adsorbents 14.

The canister 13 is communicated to the intake pipe 2 through a purge passage 15 and is communicated to atmosphere through a purge air passage 16 A purge valve 17 is provided in the purge passage 15 to open/close the purge passage. The purge valve 17 is an electromagnetic valve of which opening degree is controlled by an electronic control unit (ECU) 100. The opening degree of the purge valve 17 is adjusted by duty signal from the ECU 100.

When the purge valve 17 is opened, air introduced through the purge air passage 16 and the fuel vapor desorbed from the adsorbents 14 are suctioned into the intake pipe 2 through the purge passage 15 by negative pressure in the intake pipe 2. The mixture gas of air and fuel vapor that is introduced into the intake pipe 2 is referred to as purge gas hereinafter.

The purge passage 15 is provided with a concentration sensor 18 that detects fuel vapor concentration in the purge gas. The fuel vapor concentration is referred to as HC concentration hereinafter.

The ECU 100 includes a microcomputer having memories. The ECU 100 controls the purge valve 17 based on coolant temperature, engine speed, accelerator position, on-off state of ignition switch and the like. Furthermore, the ECU 100 controls fuel injection quantity, opening degree of the throttle valve 3, ignition timing of the engine 1, and the like.

A method for estimating HC concentration in the purge gas at a vicinity of the fuel injector 6 at a purge process will be described hereinafter. The HC concentration in the purge gas at the vicinity of the fuel injector 6 is referred to as injector vicinity HC concentration hereinafter.

Figure 2:
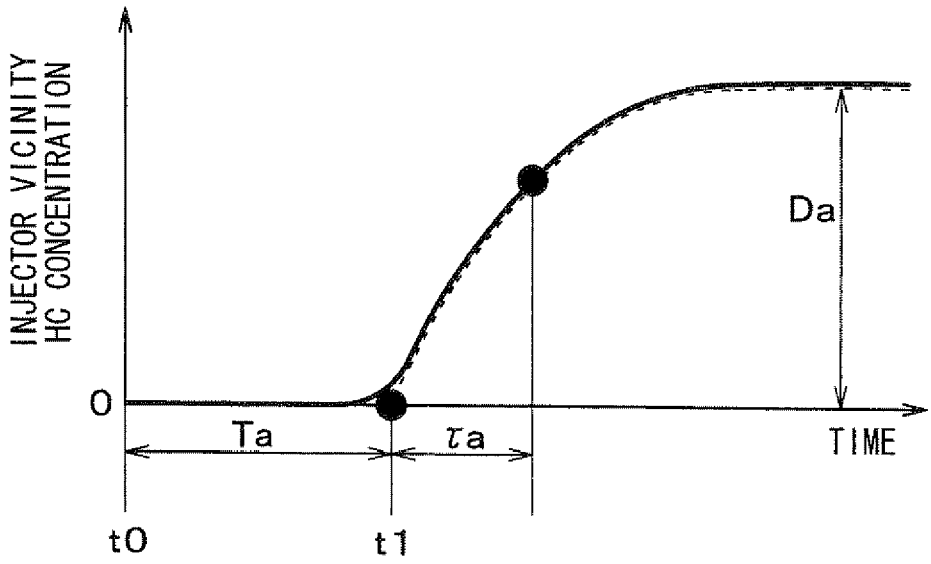
FIG. 2 is a graph showing HC concentration at a vicinity of a fuel injector at a time of starting a purge process.

FIG. 2 is a graph showing the injector vicinity HC concentration at a vicinity of a fuel injection when the purge process is started. In FIG. 2, a solid line shows an actual characteristic and a dashed line shows a first-order lag curve.

As shown in FIG. 2, when the purge valve 17 is opened at a time of t0 to start the purge process, the purge gas initially passed through the purge valve 17 reaches the fuel injector 6 at a time of t1 after a transit time Ta has elapsed. The transit time Ta is comprised of a purge passage transit time and an intake pipe transit time. That is, the purge gas flows in the purge passage 15 from the purge valve 17 to an outlet of the purge passage 15 in the purge passage transit time, and the purge gas flows in the intake pipe 2 from the outlet of the purge passage 15 to the fuel injector 6 in the intake pipe transit time. The transit time Ta can be computed based on the intake air pressure and the intake air flow rate. Specifically, as the intake air pressure increases, the transit time Ta becomes longer, and as the intake air flow rate increases, the transit time Ta becomes shorter.

The injector vicinity HC concentration begins to rise from the time of t1 after the transit time Ta has elapsed. A behavior of the injector vicinity HC concentration can be expressed by the first-order lag curve which is defined by a maximum variation Da of the injector vicinity HC concentration and time constant $\tau a$. This is confirmed based on simulations and experiments in various engines, which are conducted by the inventors.

The maximum variation Da of the injector vicinity HC concentration can be computed based on the HC concentration in the purge passage 15, flow rate of purge gas in the purge passage 15, and intake air flow rate of the engine 1. Specifically, as the HC concentration in the purge passage 15 increases, the maximum variation Da increases. As the purge gas flow rate in the purge passage 15 increases, the maximum variation Da increases. As the intake air flow rate increases, the maximum variation Da decreases. The purge gas flow rate can be computed based on the intake air pressure.

The time constant $\tau a$ can be computed based on the intake air pressure and the intake air flow rate. Specifically, as the intake air pressure increases, the time constant $\tau a$ becomes larger. As the intake air flow rate increases, the time constant $\tau a$ becomes smaller. This is confirmed based on simulations and experiments in various engines, which are conducted by the inventors.

Hence, the injector vicinity HC concentration can be computed at an arbitrary time after the purge valve 17 is opened based on the transit time Ta, the maximum variation Da of the injector vicinity HC concentration, and the time constant $\tau a$. Correcting the fuel injection quantity in accordance with the injector vicinity HC concentration can restrict a disturbance of air-fuel ratio at the time of starting the purge process.

Figure 3:
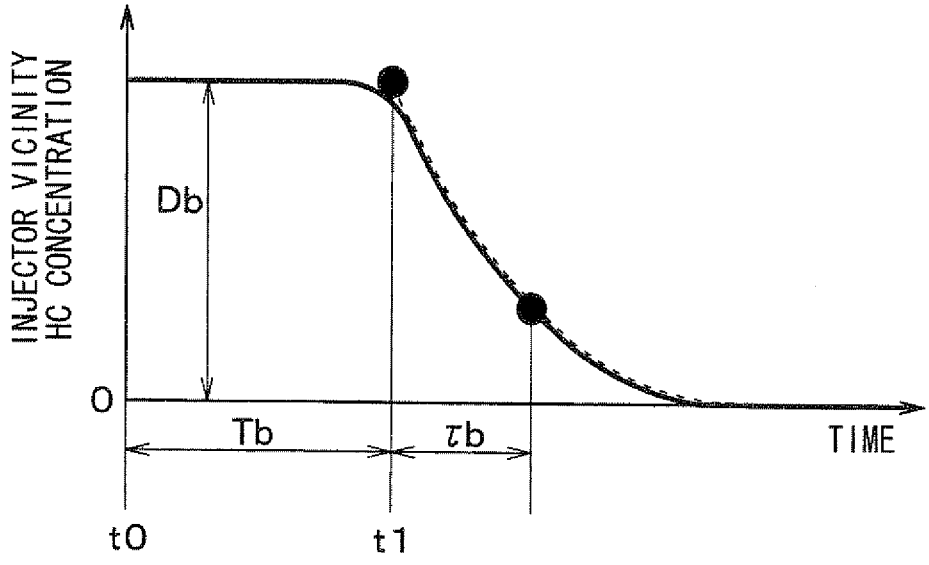
FIG. 3 is a graph showing HC concentration at a vicinity of a fuel injector at a time of terminating a purge process.

FIG. 3 is a graph showing the injector vicinity HC concentration when the purge process is terminated. In FIG. 3, a solid line shows an actual characteristic and a dashed line shows a first-order lag curve.

As shown in FIG. 3, when the purge valve 17 is closed at a time of t0 to terminate the purge process, the purge gas lastly passed through the purge valve 17 reaches the fuel injector 6 at a time of t1 after a transit time Tb has elapsed. The transit time Tb can be computed in a same manner as to compute the transit time Ta. Specifically, as the intake air pressure increases, the transit time Tb becomes longer, and as the intake air flow rate increases, the transit time Tb becomes shorter.

The injector vicinity HC concentration begins to decrease from the time of t1 after the transit time Tb has elapsed. A behavior of the injector vicinity HC concentration can be expressed by the first-order lag curve which is defined by a maximum variation Db of the injector vicinity HC concentration and time constant $\tau b$. This is confirmed based on simulations and experiments in various engines, which are conducted by the inventors.

The maximum variation Db can be computed in the same manner as to compute the maximum variation Da. Specifically, as the HC concentration in the purge passage 15 increases right before the purge process is terminated, the maximum variation Db increases. As the purge gas flow rate in the purge passage 15 increases right before the purge process is terminated, the maximum variation Db increases. As the intake air flow rate increases, the maximum variation Db decreases.

The time constant $\tau b$ can be computed based on the intake air pressure and the intake air flow rate. Specifically, as the intake air pressure increases, the time constant $\tau b$ becomes larger. As the intake air flow rate increases, the time constant $\tau b$ becomes smaller. This is confirmed based on simulations and experiments in various engines, which are conducted by the inventors.

Hence, the injector vicinity HC concentration can be computed at an arbitrary time after the purge valve 17 is closed based on the transit time Tb, the maximum variation Db of the injector vicinity HC concentration, and the time constant $\tau b$. Correcting the fuel injection quantity in accordance with the injector vicinity HC concentration can restrict a disturbance of air-fuel ratio at the time of terminating the purge process.

Figure 4:
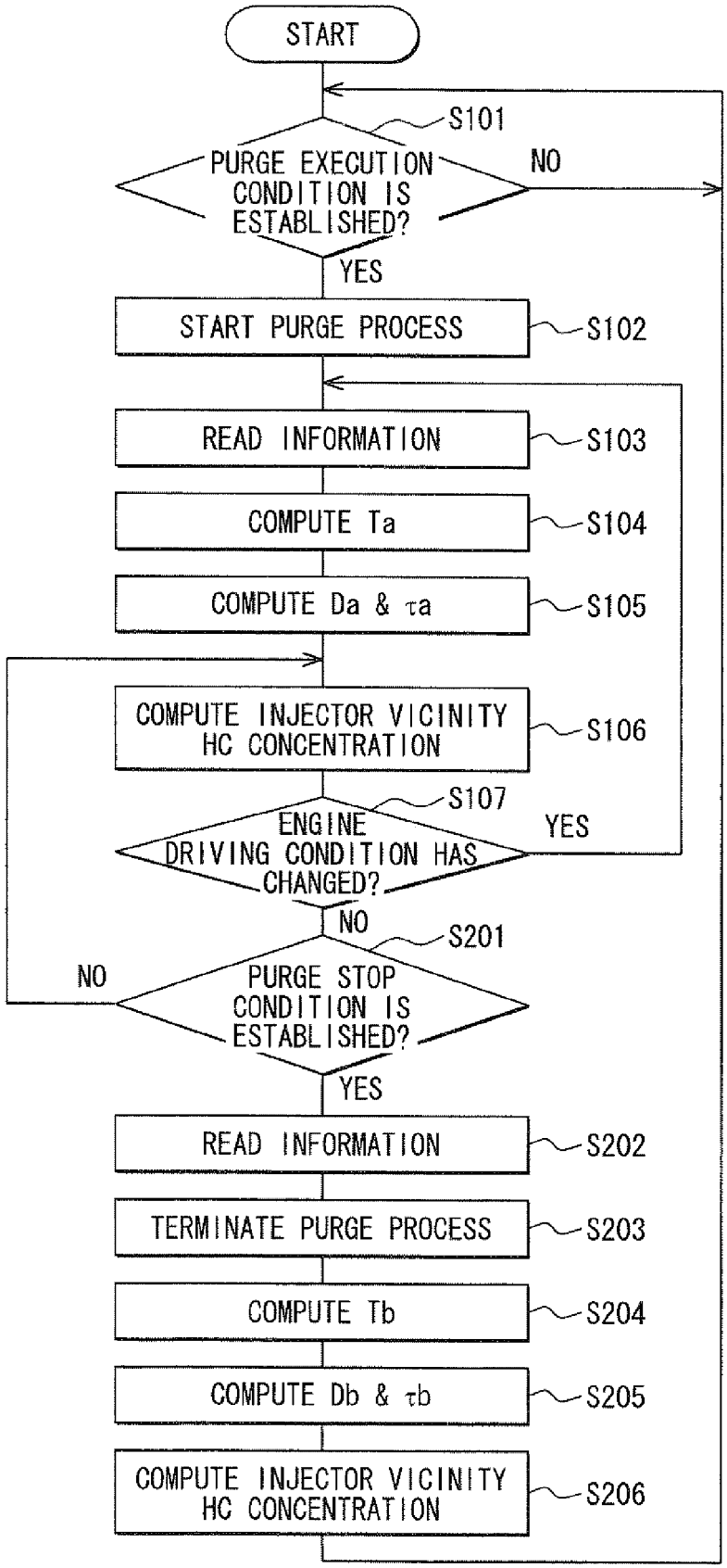
FIG. 4 is a flowchart showing a purge process which is executed by an electronic control unit.

FIG. 4 is a flowchart showing a purge process executed by the ECU 100. This process is started when the ignition switch is turned on, and is terminated when the ignition switch is turned off.

In S101, the computer determines whether a purge execution condition is established. Specifically, the purge execution condition is established when the coolant temperature, the engine speed, and the accelerator position are greater than thresholds.

When the purge execution condition is not established, the process in S101 is repeated until the purge execution condition is established.

When the answer is Yes in S101, the purge valve 17 is opened to start the purge process in S102.

In S103, the computer reads various kind of information. Specifically, the computer reads information indicative of the intake air flow rate, the intake air pressure, and the HC concentration in the purge passage 15.

In S104, the transit time Ta in a case of starting the purge process is computed based on the intake air pressure and the intake air flow rate. Specifically, a formulation or a map which defines a relationship between the transit time Ta and intake air pressure and the intake air flow rate is stored in the memory. The transit time Ta is derived from the formulation or the map.

In S105, the maximum variation Da and the time constant τa in a case of starting the purge process are computed.

The maximum variation Da is computed based on the HC concentration of the purge gas in the purge passage 15, the purge gas flow rate which is obtained from the intake air pressure, and the intake air flow rate. Specifically, a formulation or a map which defines a relationship between the HC concentration, the intake air pressure, the intake air flow rate and the maximum variation Da is stored in the memory. The maximum variation Da is derived from the formulation or the map.

The time constant τa in a case of starting the purge process is computed based on the intake air pressure and the intake air flow rate. Specifically, a formulation or a map which defines a relationship between the intake air pressure, the intake air flow rate and the time constant τa is stored in the memory. The time constant τa is derived from the formulation or the map.

In S106, the injector vicinity HC concentration at an arbitrary time in a case of stating the purge process is computed.

Until the transit time Ta elapses, that is, from the time of t0 to the time of t1, the injector vicinity HC concentration is "0".

The injector vicinity HC concentration after the transit time Ta has elapsed is computed based on the maximum variation Da and the time constant τa. Specifically, a formulation of the first-order lag curve or a map defined by the maximum variation Da and the time constant τa is stored in the memory of the ECU 100. The injector vicinity HC concentration after the transit time Ta has elapsed is derived from the formulation or the map.

In a fuel injection control routine, a correction value in accordance with the injector vicinity HC concentration computed in S106 is established to correct the fuel injection quantity. Hence, the disturbance of air-fuel ratio at starting the purge process is restricted.

During the purge process, the opening degree of the throttle valve 3 or the purge valve 17 may be changed due to a change in engine driving condition. In such a case, since the intake air flow rate and the purge gas flow rate are changed, the injector vicinity HC concentration may be changed. Also in this case, the injector vicinity HC concentration is obtained in the same way as the case of starting the purge process. The maximum variation Da' after the driving condition has changed is computed based on the HC concentration in the purge passage 15 after the change of the driving condition, the purge gas flow rate in the purge passage 15 which is obtained from the intake air pressure after the change of the driving condition, and intake air flow rate after the change of driving condition.

In S107, the computer determines whether the engine driving condition has changed. Specifically, the computer determines whether the engine speed, the opening degree of the throttle valve 3, or the opening degree of the purge valve 17 has changed.

When the answer is Yes in S 107, the procedure goes back to S103. The processes in S103 to S106 are executed repeatedly. The purge process is executed based on the changed engine driving condition.

When the answer is No in S107, the procedure proceeds to S201.

In S201, the computer determines whether a purge stop condition is established. Specifically, the purge stop condition is established when the vehicle is decelerated, that is, when the opening degree of the accelerator is less than a threshold and the engine speed is less than a threshold.

When the answer is No in S201, the procedure goes back to S106.

When the answer is Yes in S201, the procedure proceeds to S202 in which various information are read. Specifically, the computer reads information indicative of the intake air flow rate, the intake air pressure, and the HC concentration of the purge gas.

In S203, the purge valve 17 is closed to terminate the purge process.

In S204, the transit time Tb in a case of terminating the purge process is computed based on the intake air pressure and the intake air flow rate. Specifically, a formulation or a map which defines a relationship between the transit time Tb and intake air pressure and the intake air flow rate is stored in the memory. The transit time Tb is derived from the formulation or the map.

In S205, the maximum variation Db and the time constant τb in a case of terminating the purge process are computed.

The maximum variation Db in a case of terminating the purge process is computed based on the HC concentration of the purge gas in the purge passage 15, the purge gas flow rate which is obtained from the intake air pressure, and the intake air flow rate. Specifically, a formulation or a map which defines a relationship between the HC concentration, the intake air pressure, the intake air flow rate and the maximum variation Db is stored in the memory. The maximum variation Db is derived from the formulation or the map.

The time constant τb in a case of terminating the purge process is computed based on the intake air pressure and the intake air flow rate. Specifically, a formulation or a map which defines a relationship between the intake air pressure, the intake air flow rate and the time constant τb is stored in the memory. The time constant τb is derived from the formulation or the map, In S206, the injector vicinity HC concentration at an arbitrary time in a case of terminating the purge process is computed.

Until the transit time Tb elapses, that is, from the time of t0 to the time of t1, the injector vicinity HC concentration is identical to the maximum variation Db.

The injector vicinity HC concentration after the transit time Tb has elapsed is computed based on the maximum variation Db and the time constant τb computed in S205. Specifically, a formulation of the first-order lag curve or a map defined by the maximum variation Db and the time constant τb is stored in the memory of the ECU 100. The injector vicinity HC concentration after the transit time Tb has elapsed is derived from the formulation or the map.

In a fuel injection control routine, a correction value in accordance with the injector vicinity HC concentration computed in S206 is established to correct the fuel injection quantity. Hence, the disturbance of air-fuel ratio at terminating the purge process is restricted.

The HC concentration of the purge gas in the purge passage 15 may be computed based on a variation in air-fuel ratio at a time of closing the purge valve 17.

In the purge process, the transit time Ta, Tb and the time constant τa, τb may be converted into a crank angle of the internal combustion engine 1.

What is claimed is:

1. A fuel vapor treatment system mounted on an internal combustion engine which has a fuel injector for injecting fuel into an intake pipe, comprising:

a canister containing an adsorbent which temporarily adsorbs fuel vapor generated in a fuel tank;

a purge passage which introduces fuel vapor desorbed from the canister into the intake pipe;

a purge valve which opens/closes the purge passage;

a transit time computing means for computing a first transit time from a time when the fuel vapor passes the purge valve right after the purge valve is opened until a time when the fuel vapor reaches a vicinity of the fuel injector; and a concentration computing means for computing a fuel vapor concentration at the vicinity of the fuel injector after the first transit time has elapsed based on a first-order lag curve which is defined by a maximum variation of the fuel vapor concentration and a time constant.

2. A fuel vapor treatment system mounted on an internal combustion engine which has a fuel injector for injecting fuel into an intake pipe, comprising:

a canister containing an adsorbent which temporarily adsorbs fuel vapor generated in a fuel tank;

a purge passage which introduces fuel vapor desorbed from the canister into the intake pipe;

a purge valve which opens/closes the purge passage;

a transit time computing means for computing a second transit time from a time when the fuel vapor passes the purge valve right before the purge valve is closed until a time when the fuel vapor reaches a vicinity of the fuel injector; and a concentration computing means for computing a fuel vapor concentration at the vicinity of the fuel injector after the second transit time has elapsed based on a first-order lag curve which is defined by a maximum variation of the fuel vapor concentration and a time constant.

3. A fuel vapor treatment system according to claim 1, wherein the concentration computing means increases the time constant as an intake air pressure of the internal combustion engine increases.

4. A fuel vapor treatment system according to claim 2, wherein the concentration computing means increases the time constant as an intake air pressure of the internal combustion engine increases.

5. A fuel vapor treatment system according to claim 3, wherein the concentration computing means decreases the time constant as an intake air flow rate increases.

6. A fuel vapor treatment system according to claim 4, wherein the concentration computing means decreases the time constant as an intake air flow rate increases.

7. A fuel vapor treatment system according to claim 1 wherein the first transit time increases as an intake air pressure increases.

8. A fuel vapor treatment system according to claim 2, wherein the second transit time increases as an intake air pressure increases.

9. A fuel vapor treatment system according to claim 7, wherein the first transit time decreases as the intake air flow rate increases.

10. A fuel vapor treatment system according to claim 8, wherein the second transit time decreases as the intake air flow rate increases.

* * * * *